US007150780B2

(12) United States Patent
Krichtafovitch et al.

(10) Patent No.: US 7,150,780 B2
(45) Date of Patent: Dec. 19, 2006

(54) ELECTROSTATIC AIR CLEANING DEVICE

(75) Inventors: Igor A. Krichtafovitch, Kirkland, WA (US); Vladimir L. Gorobets, Redmond, WA (US)

(73) Assignee: Kronos Advanced Technology, Inc., Belmont, MA (US)

( * ) Notice: Subject to any disclaimer, the term of this patent is extended or adjusted under 35 U.S.C. 154(b) by 52 days.

(21) Appl. No.: 10/752,530

(22) Filed: Jan. 8, 2004

(65) Prior Publication Data

US 2005/0150384 A1 Jul. 14, 2005

(51) Int. Cl.
*B03C 3/08* (2006.01)
*B03C 3/12* (2006.01)

(52) U.S. Cl. ..... 96/72; 96/79; 96/95; 96/98; 361/230; 361/231; 361/233; 422/54; 422/186.01; 422/186.07; 315/111.91; 315/111.21; 250/423 R; 55/DIG. 39

(58) Field of Classification Search ..... 96/72, 96/79, 95, 98; 361/230, 231, 233; 422/54, 422/186.01, 186.07; 315/111.91, 111.21; 250/423 R; 55/DIG. 39
See application file for complete search history.

(56) References Cited

U.S. PATENT DOCUMENTS 1,345,790 A 7/1920 Lodge
1,888,606 A 11/1932 Nesbit
2,587,173 A * 2/1952 Landgraf ..... 96/95
2,590,447 A 3/1952 Nord. Jr. et al.
2,765,975 A 10/1956 Lindenblad
2,815,824 A 12/1957 Armstrong et al.
2,826,262 A 3/1958 Byerly
2,949,550 A 8/1960 Brown
3,026,964 A 3/1962 Penney
3,071,705 A 1/1963 Coleman et al.
3,108,394 A 10/1963 Ellman et al.
3,198,726 A 8/1965 Trikilis
3,267,860 A 8/1966 Brown
3,374,941 A 3/1968 Okress
3,518,462 A 6/1970 Brown
3,582,694 A 6/1971 Gourdine
3,638,058 A 1/1972 Fritzius
3,675,096 A 7/1972 Kiess
3,699,387 A 10/1972 Edwards
3,740,927 A 6/1973 Vincent
3,751,715 A 8/1973 Edwards
3,892,927 A 7/1975 Lindenberg
3,896,347 A 7/1975 Gelfand
3,907,520 A 9/1975 Huang et al.

(Continued)

OTHER PUBLICATIONS

Request for Ex Parte Reexamination under 37 C.F.R. 1.510: application No. 90/007,276, filed on Oct. 29, 2004.

(Continued)

*Primary Examiner*—Duane Smith
*Assistant Examiner*—Minh-Chau T. Pham
(74) *Attorney, Agent, or Firm*—Fulbright & Jaworski LLP

(57) ABSTRACT

An electrostatic air cleaning device includes an array of electrodes. The electrodes include corona electrodes connected to a suitable source of high voltage so as to generate a corona discharge. Laterally displaced collecting electrodes include one or more bulges that have aerodynamic frontal "upwind" surfaces and airflow disrupting tailing edges downwind that create quite zones for the collection of particulates removed from the air. The bulges may be formed as rounded leading edges on the collecting electrodes and/or as ramped surfaces located, for example, along a midsection of the electrodes. Repelling electrodes positioned between pairs of the collecting electrodes may include similar bulges such as cylindrical or semi-cylindrical leading and/or trailing edges.

44 Claims, 13 Drawing Sheets

U.S. PATENT DOCUMENTS

| | | | | |
|---|---|---|---|---|
| 3,918,939 | A | 11/1975 | Hardt | |
| 3,936,635 | A | 2/1976 | Clark | |
| 3,981,695 | A | 9/1976 | Fuchs | |
| 3,983,393 | A | 9/1976 | Thettu et al. | |
| 3,984,215 | A | 10/1976 | Zucker | |
| 4,008,057 | A | 2/1977 | Gelfand et al. | |
| 4,011,719 | A | 3/1977 | Banks | |
| 4,061,961 | A | 12/1977 | Baker | |
| 4,086,152 | A | 4/1978 | Rich et al. | |
| 4,086,650 | A | 4/1978 | Davis et al. | |
| 4,124,003 | A | 11/1978 | Abe et al. | |
| 4,126,434 | A | 11/1978 | Keiichi | |
| 4,156,885 | A | 5/1979 | Baker et al. | |
| 4,162,144 | A | 7/1979 | Cheney | |
| 4,210,847 | A | 7/1980 | Shannon et al. | |
| 4,216,000 | A | 8/1980 | Kofoid | |
| 4,231,766 | A * | 11/1980 | Spurgin | 96/79 |
| 4,232,355 | A | 11/1980 | Finger et al. | |
| 4,240,809 | A | 12/1980 | Elsbernd et al. | |
| RE30,480 | E | 1/1981 | Gelfand | |
| 4,246,010 | A | 1/1981 | Honacker | |
| 4,259,707 | A | 3/1981 | Penney | |
| 4,266,948 | A | 5/1981 | Teague et al. | |
| 4,267,502 | A | 5/1981 | Reese et al. | |
| 4,292,493 | A | 9/1981 | Selander et al. | |
| 4,313,741 | A | 2/1982 | Masuda et al. | |
| 4,315,837 | A | 2/1982 | Rourke et al. | |
| 4,335,414 | A | 6/1982 | Weber | |
| 4,351,648 | A | 9/1982 | Penney | |
| 4,369,776 | A | 1/1983 | Roberts | |
| 4,376,637 | A | 3/1983 | Yang | |
| 4,379,129 | A | 4/1983 | Abe | |
| 4,380,720 | A | 4/1983 | Fleck | |
| 4,388,274 | A | 6/1983 | Rourke et al. | |
| 4,390,831 | A | 6/1983 | Byrd et al. | |
| 4,401,385 | A | 8/1983 | Katayama et al. | |
| 4,477,268 | A | 10/1984 | Kalt | |
| 4,481,017 | A | 11/1984 | Furlong | |
| 4,496,375 | A | 1/1985 | Le Vantine | |
| 4,567,541 | A | 1/1986 | Terai | |
| 4,600,411 | A | 7/1986 | Santamaria | |
| 4,604,112 | A | 8/1986 | Ciliberti et al. | |
| 4,632,135 | A | 12/1986 | Lenting et al. | |
| 4,643,745 | A | 2/1987 | Sakakibara et al. | |
| 4,646,196 | A | 2/1987 | Reale | |
| 4,649,703 | A | 3/1987 | Dettling et al. | |
| 4,673,416 | A | 6/1987 | Sakakibara et al. | |
| 4,689,056 | A | 8/1987 | Noguchi et al. | |
| 4,713,724 | A | 12/1987 | Voelkel | |
| 4,719,535 | A | 1/1988 | Zhenjun et al. | |
| 4,740,862 | A | 4/1988 | Halleck | |
| 4,741,746 | A | 5/1988 | Chao et al. | |
| RE32,767 | E * | 10/1988 | Jonelis | 55/440 |
| 4,775,915 | A | 10/1988 | Walgrove, III | |
| 4,783,595 | A | 11/1988 | Seidl | |
| 4,789,801 | A | 12/1988 | Lee | |
| 4,790,861 | A | 12/1988 | Watai et al. | |
| 4,811,159 | A | 3/1989 | Foster, Jr. | |
| 4,812,711 | A | 3/1989 | Torok et al. | |
| 4,837,658 | A | 6/1989 | Reale | |
| 4,838,021 | A | 6/1989 | Beattie | |
| 4,853,719 | A | 8/1989 | Reale | |
| 4,853,735 | A | 8/1989 | Kodama et al. | |
| 4,878,149 | A | 10/1989 | Stiehl et al. | |
| 4,924,937 | A | 5/1990 | Beal et al. | |
| 4,938,786 | A | 7/1990 | Tonomoto | |
| 4,941,068 | A | 7/1990 | Hofmann | |
| 4,941,353 | A | 7/1990 | Fukatsu et al. | |
| 4,980,611 | A | 12/1990 | Orenstein | |
| 4,996,473 | A | 2/1991 | Markson et al. | |
| 5,012,159 | A | 4/1991 | Torok et al. | |
| 5,024,685 | A | 6/1991 | Torok et al. | |
| 5,055,118 | A | 10/1991 | Nagoshi et al. | |
| 5,059,219 | A | 10/1991 | Plaks et al. | |
| 5,072,746 | A | 12/1991 | Kantor | |
| 5,076,820 | A * | 12/1991 | Gurvitz | 96/72 |
| 5,077,500 | A | 12/1991 | Torok et al. | |
| 5,087,943 | A | 2/1992 | Creveling | |
| 5,136,461 | A | 8/1992 | Zellweger | |
| 5,138,513 | A | 8/1992 | Weinstein | |
| 5,155,531 | A | 10/1992 | Kurotori et al. | |
| 5,163,983 | A | 11/1992 | Lee | |
| 5,199,257 | A | 4/1993 | Colletta et al. | |
| 5,215,558 | A | 6/1993 | Moon | |
| 5,245,692 | A | 9/1993 | Kawai | |
| 5,257,073 | A | 10/1993 | Gross et al. | |
| 5,269,131 | A | 12/1993 | Brophy | |
| 5,330,559 | A | 7/1994 | Cheney et al. | |
| 5,368,839 | A | 11/1994 | Aime et al. | |
| 5,369,953 | A | 12/1994 | Brophy | |
| 5,423,902 | A | 6/1995 | Strutz et al. | |
| 5,469,242 | A | 11/1995 | Yu et al. | |
| 5,474,599 | A | 12/1995 | Cheney et al. | |
| 5,484,472 | A | 1/1996 | Weinberg | |
| 5,508,880 | A | 4/1996 | Beyer | |
| 5,535,089 | A | 7/1996 | Ford et al. | |
| 5,556,448 | A | 9/1996 | Cheney et al. | |
| 5,569,368 | A | 10/1996 | Larsky et al. | |
| 5,578,112 | A | 11/1996 | Krause | |
| 5,601,636 | A | 2/1997 | Glucksman | |
| 5,656,063 | A | 8/1997 | Hsu | |
| 5,661,299 | A | 8/1997 | Purser | |
| 5,665,147 | A | 9/1997 | Taylor et al. | |
| 5,667,564 | A | 9/1997 | Weinberg | |
| 5,707,428 | A | 1/1998 | Feldman et al. | |
| 5,769,155 | A | 6/1998 | Ohadi et al. | |
| 5,779,769 | A | 7/1998 | Jiang | |
| 5,814,135 | A | 9/1998 | Weinberg | |
| 5,827,407 | A | 10/1998 | Wang et al. | |
| 5,847,917 | A | 12/1998 | Suzuki | |
| 5,854,742 | A | 12/1998 | Faulk | |
| 5,892,363 | A | 4/1999 | Roman | |
| 5,894,001 | A | 4/1999 | Hitzler et al. | |
| 5,899,666 | A | 5/1999 | Chung et al. | |
| D411,001 | S | 6/1999 | Pinchuk | |
| 5,920,474 | A | 7/1999 | Johnson et al. | |
| 5,951,957 | A | 9/1999 | Simpson | |
| 5,973,905 | A | 10/1999 | Shaw | |
| 5,982,102 | A | 11/1999 | Andrzej | |
| 5,993,521 | A | 11/1999 | Loreth et al. | |
| D420,438 | S | 2/2000 | Pinchuk | |
| 6,023,155 | A | 2/2000 | Kalinsky et al. | |
| 6,042,637 | A | 3/2000 | Weinberg | |
| 6,056,808 | A | 5/2000 | Krause | |
| D427,300 | S | 6/2000 | Pinchuk | |
| 6,084,350 | A | 7/2000 | Ezaki et al. | |
| 6,108,504 | A | 8/2000 | Dickhoff | |
| 6,125,636 | A | 10/2000 | Taylor et al. | |
| D433,494 | S | 11/2000 | Pinchuk et al. | |
| D434,483 | S | 11/2000 | Pinchuk | |
| 6,145,298 | A | 11/2000 | Burton | |
| 6,152,146 | A | 11/2000 | Taylor et al. | |
| 6,163,098 | A | 12/2000 | Taylor et al. | |
| 6,167,196 | A | 12/2000 | Huggins et al. | |
| 6,176,977 | B1 | 1/2001 | Taylor et al. | |
| 6,182,671 | B1 | 2/2001 | Taylor et al. | |
| D438,513 | S | 3/2001 | Pinchuk | |
| 6,195,827 | B1 | 3/2001 | Dumitriu | |
| 6,200,539 | B1 | 3/2001 | Sherman et al. | |
| 6,203,600 | B1 | 3/2001 | Loreth | |
| D440,290 | S | 4/2001 | Pinchuk | |
| 6,210,642 | B1 | 4/2001 | Lee et al. | |
| 6,215,248 | B1 * | 4/2001 | Noll | 313/633 |
| 6,228,330 | B1 | 5/2001 | Herrmann et al. | |

6,245,126 B1 6/2001 Feldman et al.
6,245,132 B1 6/2001 Feldman et al.
6,312,507 B1 11/2001 Taylor et al.
6,313,064 B1 11/2001 Miyafuji et al.
6,350,417 B1 2/2002 Lau et al.
6,394,086 B1 5/2002 Barnes et al.
6,504,308 B1 * 1/2003 Krichtafovitch et al. ..... 315/111.91
6,574,123 B1 6/2003 Wiser et al.
6,603,268 B1 8/2003 Lee
6,664,741 B1 12/2003 Krichtafovitch
2001/0004046 A1 6/2001 Taylor et al.
2001/0032544 A1 10/2001 Taylor et al.
2001/0048906 A1 12/2001 Lau et al.
2002/0079212 A1 6/2002 Taylor et al.
2002/0098131 A1 7/2002 Taylor et al.
2002/0122751 A1 9/2002 Sinaiko et al.
2002/0122752 A1 9/2002 Taylor et al.
2002/0127156 A1 9/2002 Taylor
2002/0141914 A1 10/2002 Lau et al.
2002/0155041 A1 10/2002 McKinney, Jr. et al.
2003/0033176 A1 2/2003 Hancock
2003/0147785 A1 8/2003 Joannou
2003/0165410 A1 9/2003 Taylor
2003/0170150 A1 9/2003 Lau et al.
2003/0206837 A1 11/2003 Taylor et al.
2003/0206839 A1 11/2003 Taylor et al.
2003/0206840 A1 11/2003 Taylor et al.
2003/0209420 A1 11/2003 Taylor et al.
2003/0234618 A1 12/2003 Krichtafovitch
2004/0004440 A1 1/2004 Krichtafovitch et al.
2004/0004797 A1 1/2004 Krichtafovitch et al.
2004/0025497 A1 2/2004 Truce
2004/0033340 A1 2/2004 Lau et al.
2004/0047775 A1 3/2004 Lau et al.
2004/0052700 A1 3/2004 Kotlyar et al.
2004/0057882 A1 3/2004 Lau et al.
2004/0079233 A1 4/2004 Lau et al.

OTHER PUBLICATIONS

Manual on Current Mode PWM Controller, LinFinity Microelectronics (SG1842/SG1843 Series, Apr. 2000).
Product Catalog of GE-Ding Information Inc. (From Website—www.reedsensor.com.tw).
Written Opinion of the International Searching Authority.
International Search Report.

* cited by examiner

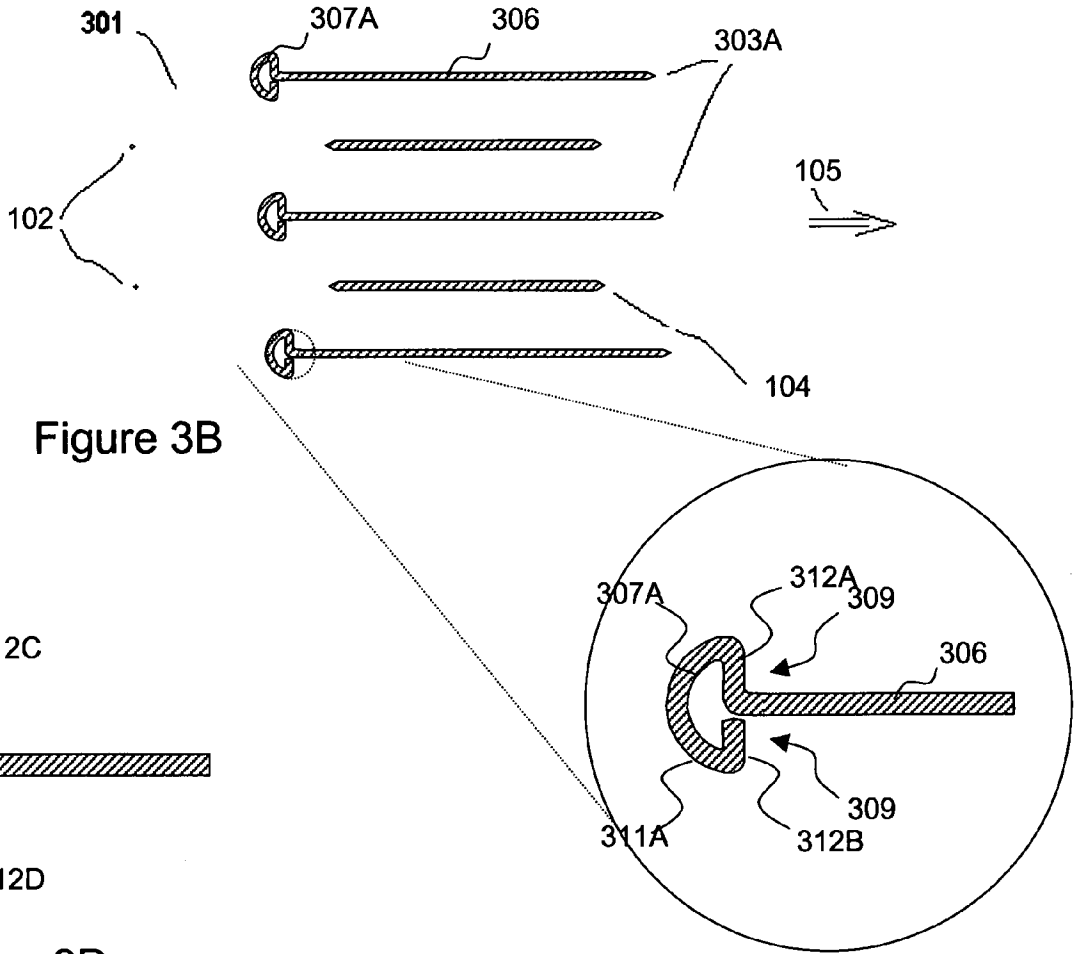
Figure 3B
Figure 3C
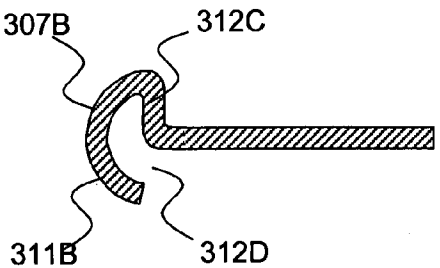
Figure 3D

ELECTROSTATIC AIR CLEANING DEVICE

RELATED APPLICATIONS

The instant application is related to U.S. patent application Ser. No. 09/419,720 filed Oct. 14, 1999 and entitled *Electrostatic Fluid Accelerator*, now U.S. Pat. No. 6,504,308; U.S. patent application Ser. No. 10/187,983 filed Jul. 3, 2002 and entitled *Spark Management And Device*; U.S. patent application Ser. No. 10/175,947 filed Jun. 21, 2002 and entitled *Method Of And Apparatus For Electrostatic Fluid Acceleration Control Of A Fluid Flow* and the Continuation-In-Part thereof, U.S. patent application Ser. No. 10/735,302 filed Dec. 15, 2003 of the same title; U.S. patent application Ser. No. 10/188,069 filed Jul. 3, 2002 and entitled *Electrostatic Fluid Accelerator For And A Method Of Controlling Fluid Flow*; U.S. patent application Ser. No. 10/352,193 filed Jan. 28, 2003 and entitled *An Electroststic Fluid Accelerator For Controlling Fluid Flow*; U.S. patent application Ser. No. 10/295,869 filed Nov. 18, 2002 and entitled *Electrostatic Fluid Accelerator*; U.S. patent application Ser. No. 10/724,707 filed Dec. 2, 2003 and entitled *Corona Discharge Electrode And Method Of Operating The Same*, each of which is incorporated herein in its entirety by reference.

BACKGROUND OF THE INVENTION

1. Field of the Invention

The invention relates to a device for electrostatic air cleaning. The device is based on the corona discharge and ions acceleration along with dust particles charging and collecting them on the oppositely charged electrodes.

2. Description of the Related Art

A number of patents (see, e.g., U.S. Pat. Nos. 4,689,056 and 5,055,118) describe electrostatic air cleaning devices that including (i) ion and resultant air acceleration generated by a corona discharge method and device coupled with (ii) charging and collection of airborne particulates, such as dust. These corona discharge devices apply a high voltage potential between corona (discharge) electrodes and collecting (or accelerating) electrodes to create a high intensity electric field and generate a corona discharge in a vicinity of the corona electrodes. Collisions between the ions generated by the corona and surrounding air molecules transfer the momentum of the ions to the air thereby inducing a corresponding movement of the air to achieve an overall movement in a desired air flow direction. U.S. Pat. No. 4,689,056 describes the air cleaner of the ionic wind type including corona electrodes constituting a dust collecting arrangement having the collecting electrodes and repelling electrodes alternately arranged downstream of said corona electrode. A high voltage (e.g., 10–25 kV) is supplied by a power source between the corona electrodes and the collecting electrodes to generate an ionic wind in a direction from the corona electrodes to the collecting electrode. As particulates present in the air pass through the corona discharge, a charge corresponding to the polarity of the corona electrodes is accumulated on these particles such that they are attracted to and accumulate on the oppositely-charged collecting electrodes. Charging and collecting of the particles effectively separates-out particulates such as dust from fluids such as air as it passes through the downstream array of collecting electrodes. Typically, the corona electrodes are supplied with a high negative or positive electric potential while the collecting electrodes are maintained at a ground potential (i.e., positive or negative with respect to the corona electrodes) and the repelling electrodes are maintained at a different potential with respect to the collecting electrodes, e.g., an intermediate voltage level. A similar arrangement is described in U.S. Pat. No. 5,055,118.

These and similar arrangements are capable of simultaneous air movement and dust collection. However, such electrostatic air cleaners have a comparatively low dust collecting efficiency that ranges between 25–90% removal of dust from the air (i.e., "cleaning efficiency"). In contrast, modern technology often requires a higher level of cleaning efficiency, typically in the vicinity of 99.97% for the removal of dust particles with diameter of 0.3 μm and larger. Therefore state-of-the-art electrostatic air cleaners can not compete with HEPA (high efficiency particulate air) filtration-type filters that, according to DOE-STD-3020-97, must meet such cleaning efficiency.

Accordingly, a need exists for an electrostatic fluid precipitator and, more particularly, an air cleaning device that is efficient at the removal of particulates present in the air.

SUMMARY OF THE INVENTION

One cause for the relatively poor collecting efficiency of electrostatic devices is a general failure to consider movement of the charged particulates and their trajectory or path being charged in the area of the corona discharge. Thus, a dust particle receives some charge as it passes near the corona electrode. The now charged particle is propelled from the corona electrodes toward and between the collecting and repelling electrodes. The electric potential difference between these electrodes plates creates a strong electric field that pushes the charged particles toward the collecting electrode. The charged dust particles then settle and remain on the collecting electrode plate.

A charged particle is attracted to the collecting electrode with a force which is proportional to the electric field strength between the collecting and repelling electrodes' plates:

$$\vec{F} = q\vec{E}$$

As expressed by this equation, the magnitude of this attractive force is proportional to the electric field and therefore to the potential difference between the collecting and repelling plates and inversely proportional to the distance between these plates. However, a maximum electric field potential difference is limited by the air electrical dielectric strength, i.e., the breakdown voltage of the fluid whereupon arcing will occur. If the potential difference exceeds some threshold level then an electrical breakdown of the dielectric occurs, resulting in extinguishment of the field and interruption of the air cleaning processing/operations. The most likely region wherein the electrical breakdown might occur is in the vicinity of the edges of the plates where the electric field gradient is greatest such that the electric field generated reaches a maximum value in such regions.

Another factor limiting particulate removal (e.g., air cleaning) efficiency is caused by the existence of a laminar air flow in-between the collecting and repelling electrodes, this type of flow limiting the speed of charged particle movement toward the plates of the collecting electrodes.

Still another factor leading to cleaning inefficiency is the tendency of particulates to dislodge and disperse after initially settling on the collecting electrodes. Once the particles come into contact with the collecting electrode, their charges dissipate so that there is no longer any electrostatic attractive force causing the particles to adhere to the electrode. Absent this electrostatic adhesion, the surrounding airflow tends to dislodge the particles, returning them to the air (or other fluid being transported) as the air flow through and transits the electrode array.

Embodiments of the invention address several deficiencies in the prior art such as: poor collecting ability, low electric field strength, charged particles trajectory and resettling of particles back onto the collecting electrodes. According to one embodiment, the collecting and repelling electrodes have a profile and overall shape that causes additional air movement to be generated in a direction toward the collecting electrodes. This diversion of the air flow is achieved by altering the profile from the typical flat, planar shape and profile with the insertion or incorporation of bulges or ridges.

Note that, as used herein and unless otherwise specified or apparent from context of usage, the terms "bulge", "projection", "protuberance", "protrusion" and "ridge" include extensions beyond a normal line or surface defined by a major surface of a structure. Thus, in the present case, these terms include, but are not limited to, structures that are either (i) contiguous sheet-like structures of substantially uniform thickness formed to include raised portions that are not coplanar with, and extend beyond, a predominant plane of the sheet such as that defined by a major surface of the sheet (e.g., a "skeletonized" structure), and (ii) compound or composite structures of varying thickness including (a) a sheet-like planar portion of substantially uniform thickness defining a predominant plane and (b) one or more "thicker" portions extending outward from the predominant plane (including structures formed integral with and/or on an underlying substrate such as lateral extensions of the planar portion).

According to one embodiment, the bulges or ridges run along a width of the electrodes, substantially transverse (i.e. orthogonal) to the overall airflow direction through the apparatus. The bulges protrude outwardly along a height direction of the electrodes. The bulges may include sheet-like material formed into a ridge or bulge and/or portions of increased electrode thickness. According to an embodiment of the invention, a leading edge of the bulge has a rounded, gradually increasing or sloped profile to minimize and/or avoid disturbance of the airflow (e.g., maintain and/or encourage a laminar flow), while a trailing portion or edge of the bulge disrupts airflow, encouraging airflow separation from the body of the electrode and inducing and/or generating a turbulent flow and/or vortices. The bulges may further create a downstream region of reduced air velocity and/or redirect airflow to enhance removal of dust and other particulates from and collection on the collecting electrodes and further retention thereof. The bulges are preferably located at the ends or edges of the electrodes to prevent a sharp increase of the electric field. Bulges may also be provided along central portions of the electrodes spaced apart from the leading edge.

In general, the bulges are shaped to provide a geometry that creates "traps" for particles. These traps should create minimum resistance for the primary airflow and, at the same time, a relatively low velocity zone on a planar portion of the collecting electrode immediately after (i.e., at a trailing edge or "downwind" of) the bulges.

Embodiments of the present invention provide an innovative solution to enhancing the air cleaning ability and efficiency of electrostatic fluid (including air) purifier apparatus and systems. The rounded bulges at the ends of the electrodes decrease the electric field around and in the vicinity of these edges while maintaining an electric potential difference and/or gradient between these electrodes at a maximum operational level without generating sparking or arcing. The bulges are also effective to make air movement turbulent. Contrary to prior teachings, a gentle but turbulent movement increases a time period during which a particular charged particle is present between the collecting and repelling electrodes. Increasing this time period enhances the probability that the particle will be trapped by and collect on the collecting electrodes. In particular, extending the time required for a charged particle to transit a region between the collecting electrodes (and repelling electrodes, if present) enhances the probability that the particle will move in sufficiently close proximity to be captured by the collecting electrodes.

The "traps" behind the bulges minimize air movement behind (i.e., immediately "downwind" of) the bulges to a substantially zero velocity and, in some situations, results in a reversal of airflow direction in a region of the trap. The reduced and/or reverse air velocity in the regions behind the traps results in those particles that settle in the trap not being disturbed by the primary or dominant airflow (i.e., the main airstream). Minimizing disturbance results in the particles being more likely to lodge in the trap area for some period of time until intentionally removed by an appropriate cleaning process.

BRIEF DESCRIPTION OF THE DRAWINGS

FIG. 3B is a schematic drawing in cross-section of an array of electrodes in which the collecting electrodes have a flattened tubular portion formed on a leading edge according to another embodiment of the invention;

FIG. 3C is a detailed view of the leading edge of the collecting electrode depicted in FIG. 3B;

FIG. 3D is a detailed view of an alternate structure for a leading edge of a collecting electrode;

DESCRIPTION OF THE PREFERRED EMBODIMENTS

Figure 1:
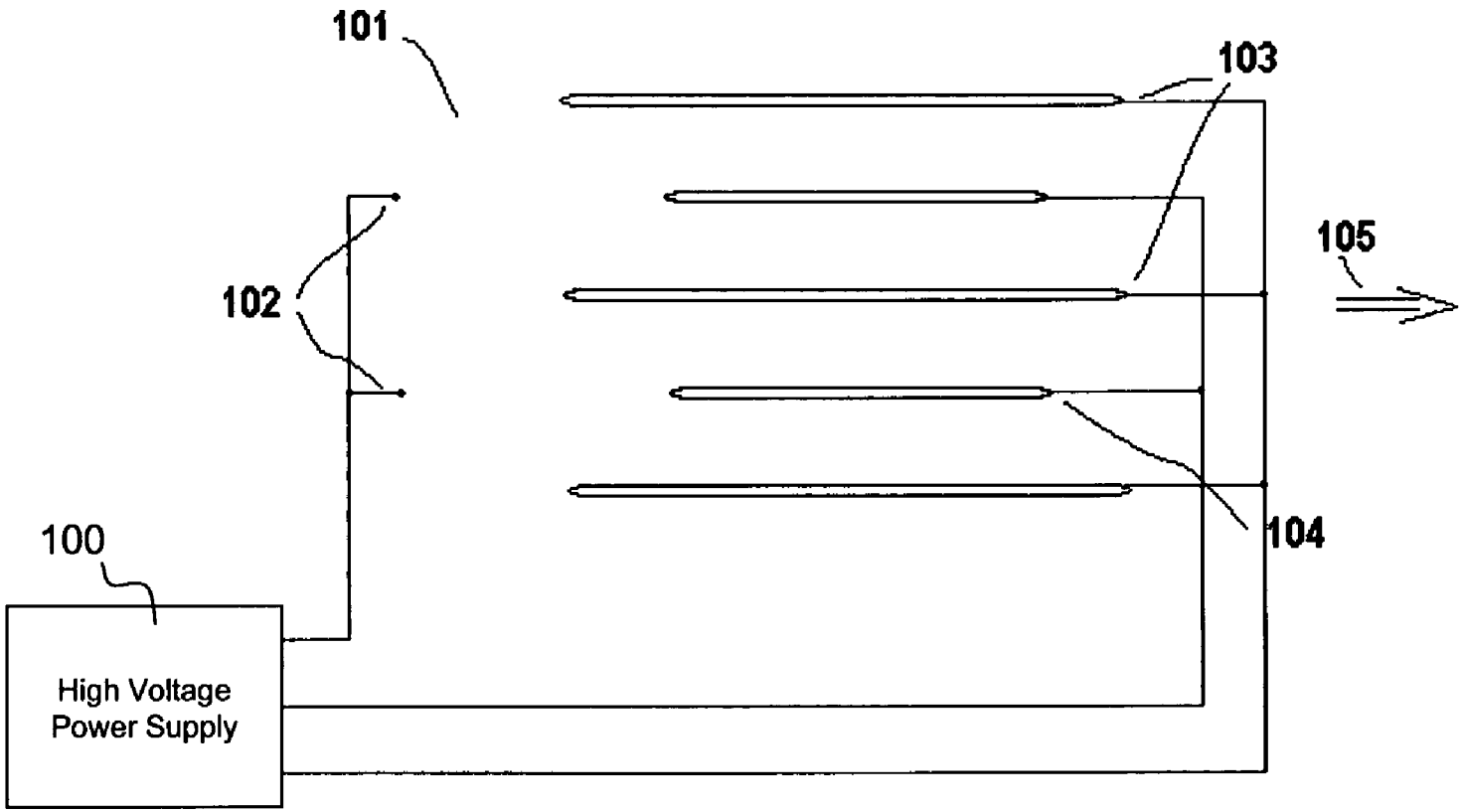
Prior Art Figure 1
FIG. 1 is a schematic drawing in cross-section of an array of corona, repelling and collecting electrodes forming part of an electrostatic air cleaning the previous art.

FIG. 1 is a schematic drawing of an array of electrodes that are part of an electrostatic air cleaning device according to the prior art. As shown, an electrostatic air cleaning device includes a high voltage power supply 100 connected to an array of electrodes 101 through which a fluid, such as air, is propelled by the action of the electrostatic fields generated by the electrodes, i.e., the corona discharge created by corona electrodes 102 accelerating air toward oppositely charged complementary electrodes such as collecting electrodes 103. The electrodes are connected to a suitable source of a high voltage (e.g., high voltage power supply 100), in the 10 kV to 25 kV range for typical spacing of the electrodes.

The array of electrodes includes three groups: (i) a subarray of laterally spaced, wire-like corona electrodes 102 (two are shown) which array is longitudinally spaced from (ii) a subarray of laterally spaced, plate-like collecting electrodes 103 (three are shown) while (iii) a subarray of plate-like repelling electrodes 104 (two are shown) are located in-between of and laterally dispersed between collecting electrodes 103. A high voltage power supply (not shown) provides the electrical potential difference between corona electrodes 102 and collecting electrodes 103 so that a corona discharge is generated around corona electrodes 102. As a result, corona electrodes 102 generate ions that are accelerated toward collecting electrodes 103 thus causing the ambient air to move in an overall or predominant desired direction indicated by arrow 105. When air having entrained therein various types of particulates, such as dust (i.e., "dirty air") enters the arrays from a device inlet portion (i.e., from the left as shown in FIG. 1 so as to initially encounter corona electrodes 102) dust particles are charged by ions emitted by corona electrodes 102. The now charged dust particles enter the passage between collecting electrodes 103 and the repelling electrodes 104. Repelling electrodes 104 are connected to a suitable power source so that they are maintained at a different electrical potential than are collecting electrodes 103, for example, a voltage intermediate or halfway between corona electrodes 102 and collecting electrodes 103. The difference in potential causes the associated electric field generated between these electrodes to accelerate the charged dust particles away from repelling electrodes 104 and toward collecting electrodes 103. However, the resultant movement toward collecting electrodes 103 occurs simultaneously with the overall or dominant air movement toward the outlet or exhaust portion of the device at the right of the drawing as depicted in FIG. 1. This resultant overall motion being predominantly toward the outlet limits the opportunity for particles to reach the surface of collecting electrodes 103 prior to exiting electrode array 101. Thus, only a limited number of particles will be acted upon to closely approach, contact and settle onto the surface of collecting electrodes 103 and thereby be removed from the passing air. This prior art arrangement therefore is incapable of operating with an air cleaning efficiency much in excess of 70–80%, i.e. 20–30% of all dust transits the device without being removed, escapes the device and reenter into the atmosphere.

Figure 2:
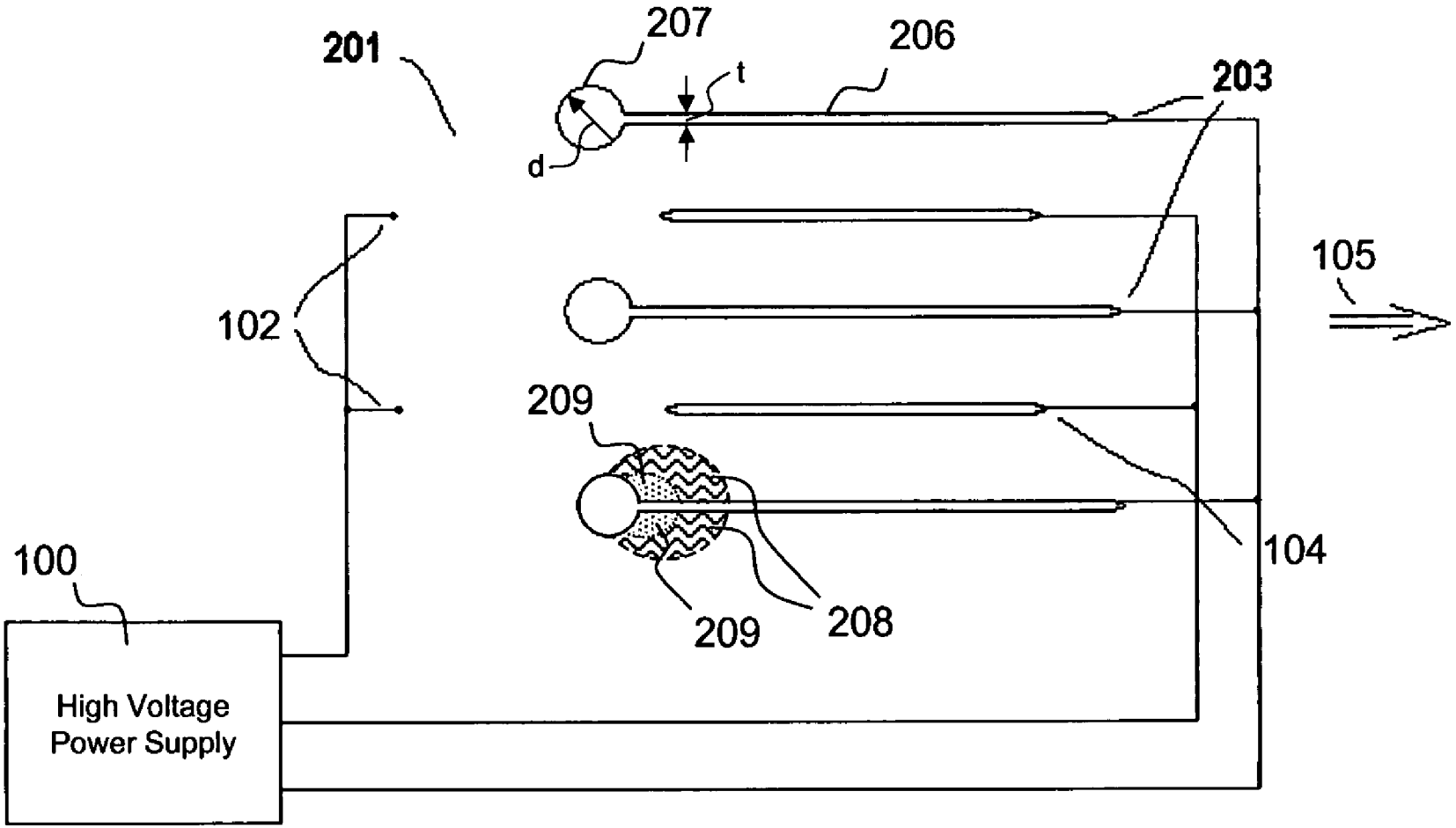
FIG. 2 is a schematic drawing in cross-section of an array of electrodes in which the collecting electrodes have a cylindrical bulge portion formed on a leading edge according to an embodiment of the present invention.

FIG. 2 shows an embodiment of the present invention wherein the geometry of the collecting electrodes is modified to redirect airflow in a manner enhancing collection and retention of particulates on and by the collecting electrodes. As shown, an electrostatic air cleaning device include an array of electrodes 201 including the same grouping of electrodes as explained in connection with FIG. 1, i.e. wire-like corona electrodes 102, collecting electrodes 203 and repelling electrodes 204. Collecting electrodes 203 are substantially planar, i.e., "plate-like" electrodes with a substantially planar portion 206 but having cylinder-shaped bulges 207 at their leading edges, i.e., the portion of the collecting electrodes nearest corona electrodes 102 is in the form of a cylindrical solid. A nominal diameter d of bulges 207 is greater than the thickness t of planar portion 206 and, more preferably, is at least two or three times that of t. For example, if planar portion 206 has a thickness t=1 mm, then d>1 mm and preferably d>2 mm, and even more preferably d>3 mm.

Corona electrodes 102, collecting electrodes 203 and repelling electrodes 204 are connected to an appropriate source of high voltages such as high voltage power supply 100 (FIG. 1). Corona electrodes 102 are connected so as to be maintained at a potential difference of 10–25 kV with reference to collecting electrodes 203 with repelling electrodes 204 maintained at some intermediate potential. Note that the electrical potential difference between the electrodes is important to device operation rather than absolute potentials. For example, any of the sets of electrodes may be maintained near or at some arbitrary ground reference potential as may be desirable or preferred for any number of reasons including, for example, ease of power distribution, safety, protection from inadvertent contact with other structures and/or users, minimizing particular hazards associated with particular structures, etc. The type of power applied may also vary such as to include some pulsating or alternating current and/or voltage component and/or relationship between such components and a constant or d.c. component of the applied power as described in one or more of the previously referenced patent applications and/or as may be described by the prior art. Still other mechanisms may be included for controlling operation of the device and performing other functions such as, for example, applying a heating current to the corona electrodes to rejuvenate the material of the electrodes by removing oxidation and/or contaminants formed and/or collecting thereon, as described in the cited related patent applications.

Figure 2A:
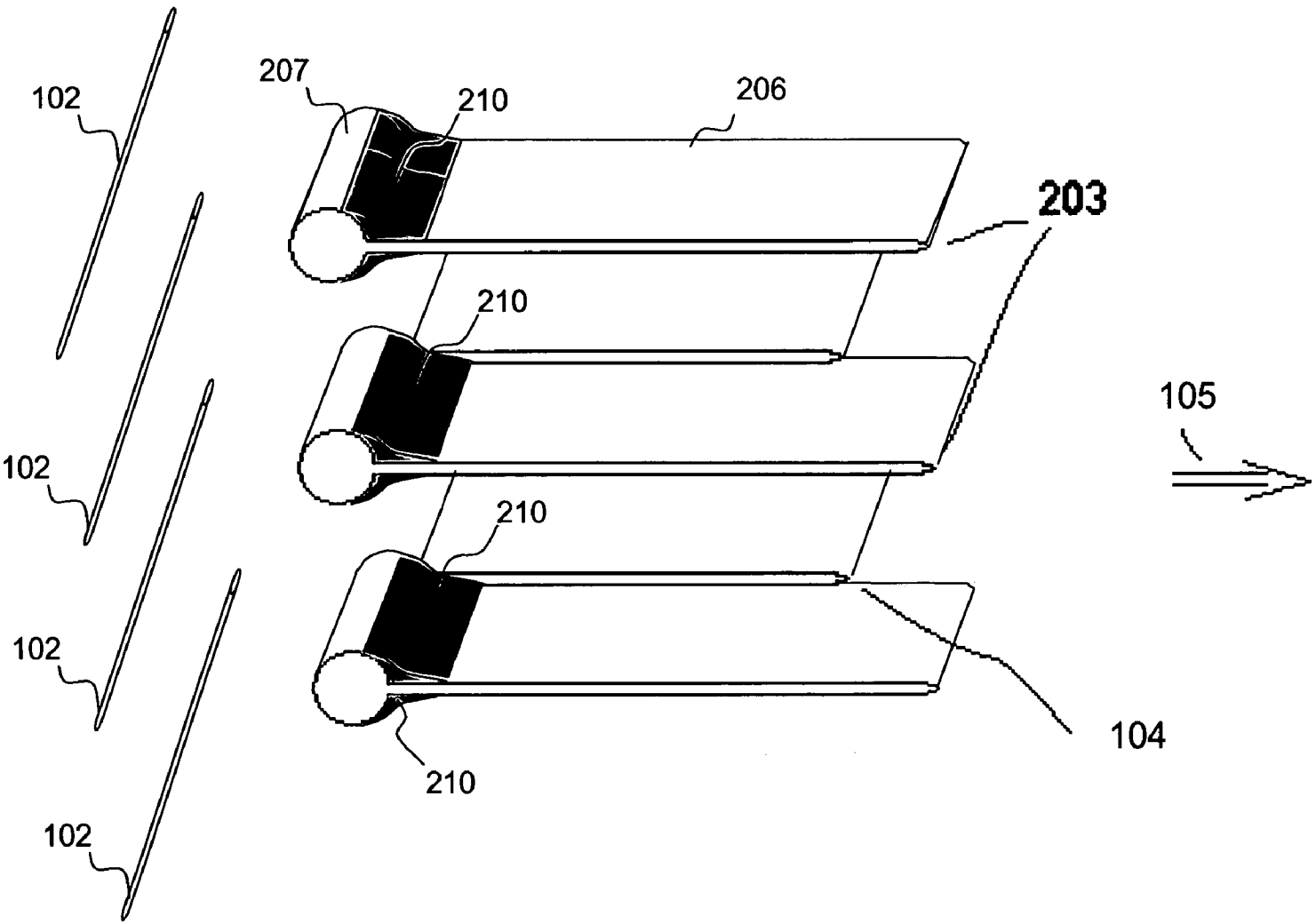
FIG. 2A is a perspective view of the electrode arrangement according to FIG. 2.

The arrangement of FIG. 2 is further depicted in the perspective view shown in FIG. 2A, although the width of collecting electrodes 203 and repelling electrodes 204 in the transverse direction (i.e., into the paper) is abbreviated for simplicity of illustration. As depicted therein, particulates 210 such as dust are attracted to and come to rest behind or downwind of cylinder-shaped bulge 207 in the general region of quiet zone 209 (FIG. 2).

Referring again to FIG. 2, the geometry of collecting electrodes 203 results in an enhanced dust collection capability and efficiency of dust removal. The enhanced efficiency is due at least in part to the altered airflow becomes turbulent in a region 208 behind cylinder-shaped bulges 207 and enters into a quiet zone 209 where charged particles settle down onto the surfaces of collecting electrodes 203 (FIG. 2A). For example, while turbulent region 208 and/or quiet zone may exhibit a relatively high Reynolds number $Re_1$ (e.g., $Re_1 \geqq 100$, preferably $Re_1 \geqq 1000$), a relatively low Reynolds number $Re_2$ would be characteristic of planar portion 206 (e.g., $Re_2 100$ and, preferably $Re_2 \geqq 100$, and more preferably $Re_2 \geqq 5$). Secondly, settled particles have greater chances to remain in the quiet zone and do not re-enter into the air. Thirdly, the bulges force air to move in a more complicated trajectory and, therefore, are in the vicinity and/or on contact with a "collecting zone" portion of collecting electrode 203 (e.g., quiet zone 209 and/or region 208) for an extended period of time. Individually and taken together these improvements dramatically increase the collecting efficiency of the device.

Figure 2B:
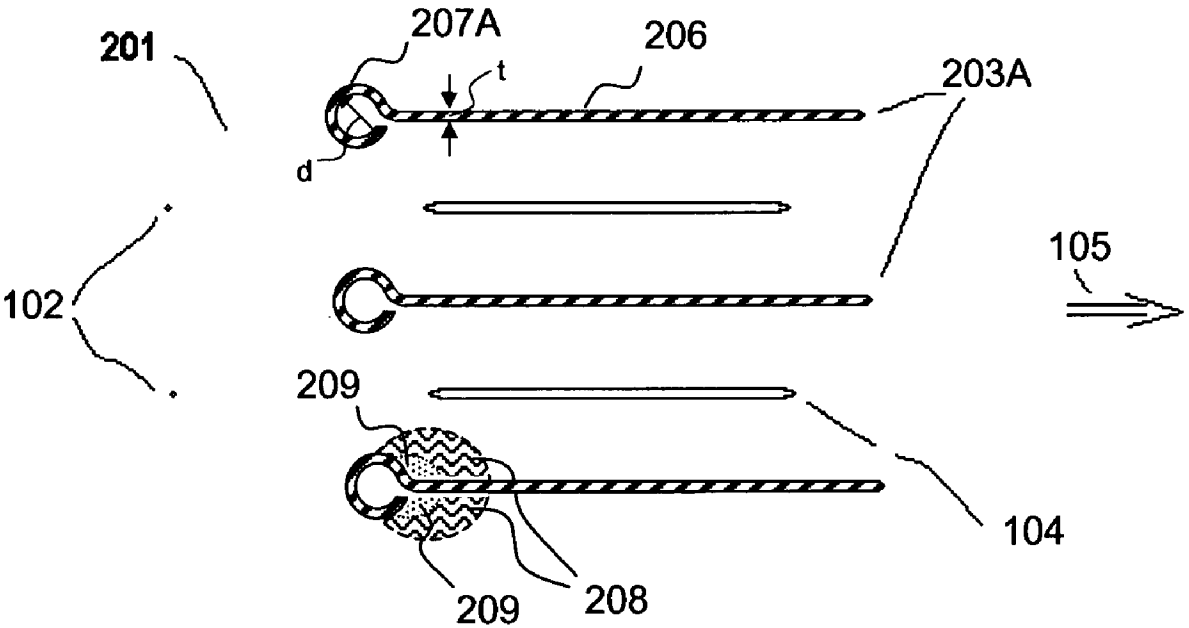
FIG. 2B is a schematic drawing in cross-section of an array of electrodes in which the collecting electrodes have a transverse tubular bulge portion formed on a leading edge according to an alternate embodiment of the invention.
Figure 2C:
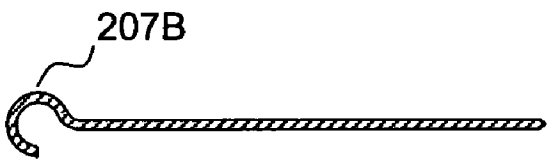
FIG. 2C is a schematic drawing in cross-section of an alternate structure of a collecting electrode with a partially open tubular leading edge.

FIG. 2B depicts and alternate construction, collecting electrodes 203A having a skeletonized construction comprising a contiguous sheet of material (e.g., an appropriate metal, metal alloy, layered structure, etc.) of substantially uniform thickness that has been formed (e.g., bent such as by stamping) to form a leading closed or open tubular bulge 207A along a leading (i.e., "upwind") edge of collecting electrodes 203A. Although tubular bulge 207A is depicted in FIG. 2B as substantially closed along its length, it may instead be formed to include open portions of varying degrees. For example, as depicted in FIG. 2C, cylindrical bulge 207B might only subtend 270 degrees or less so that the cylindrical outer surface is present facing air moving in the dominant airflow direction but is open toward the rear.

Figures 3, 3A:
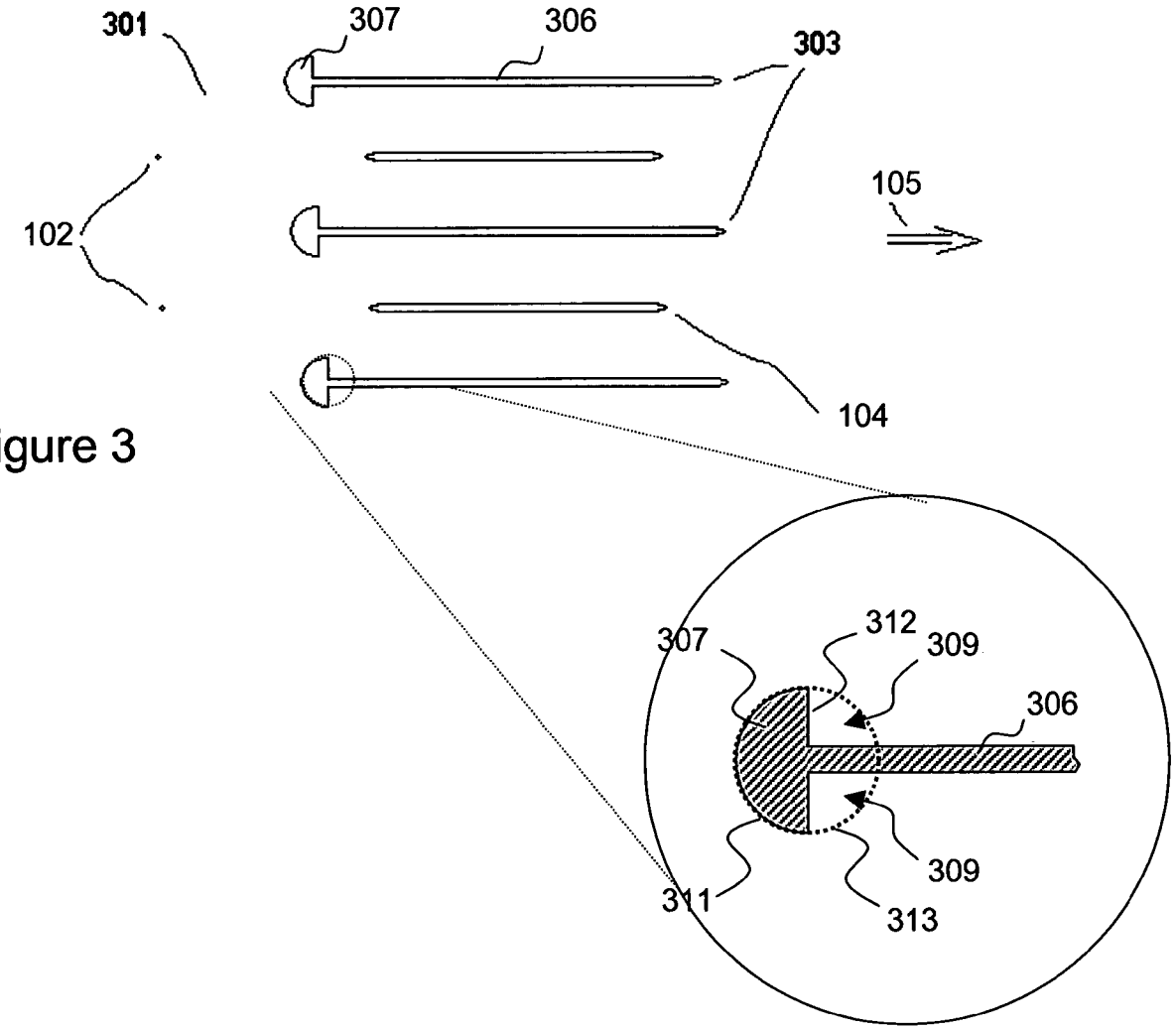
FIG. 3 is a schematic drawing in cross-section of an array of electrodes in which the collecting electrodes have a semi-cylindrical bulge portion formed on a leading edge according to another embodiment of the present invention.
FIG. 3A is a detailed view of the leading edge of the collecting electrode depicted in FIG. 3.

Further improvements may be obtained by implementing different shapes of the collecting electrode such as the semi-cylindrical geometry shown in the FIGS. 3 and 3A. As depicted therein, collecting electrodes 303 have a semi-cylindrical bulge 307 formed on a leading edge of the electrode, the remaining, downwind portion comprising a substantially planar or plate-like portion 306. Semi-cylindrical bulge 307 includes a curved leading edge 311 and a flat downwind edge 312 that joins planar portion 306. A nominal diameter of curved leading edge 311 would again be greater than the thickness of planar portion 311, and preferably two or three time that dimension. Although downwind edge 312 is shown as a substantially flat wall perpendicular to planar portion 306, other form factors and geometries may be used, preferably such that downwind edge 312 is within a circular region 313 defined by the extended cylinder coincident with curved leading edge 311 as shown in FIG. 3A. Downwind edge 312 should provide an abrupt transition so as to encourage turbulent flow and/or shield some portion of semi-cylindrical bulge 307 (or that of other bulge geometries, e.g., semi-elliptical) and/or section of planar portion 306 from direct and full-velocity predominant airflow to form a collecting or quiet zone. Establishment of a collecting or/or quiet zone 309 enhances collection efficiency and provide an environment conducive to dust settlement and retention.

A skeletonized version of a collecting electrode is depicted in FIGS. 3B, 3C and 3D. As shown in FIGS. 3B and 3C, collecting electrode 303A includes a leading edge 307A formed as a half-round tubular portion that is substantially closed except at the lateral edges, i.e., at the opposite far ends of the tube. Thus, downwind walls 312A and 312B are substantially complete.

An alternate configuration is depicted in FIG. 3D wherein leading edge 307B is formed as an open, i.e., instead of a wall, a open slit or aperture 312D runs the width of the electrode, only downwind wall 312C being present.

Figures 4, 4A:
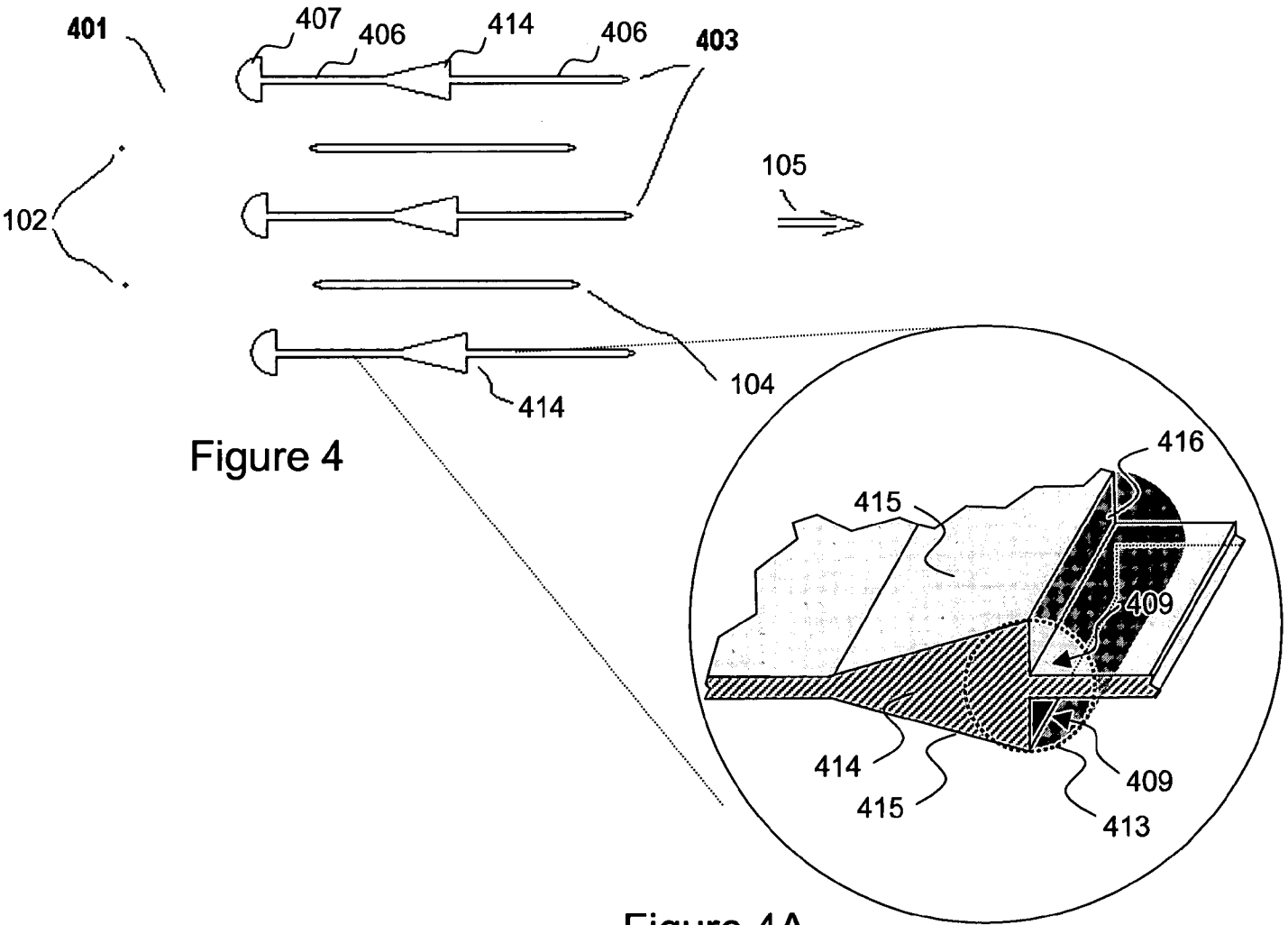
FIG. 4 is a schematic drawing in cross-section of an array of electrodes wherein the collecting electrodes have both a semi-cylindrical bulge portion formed on a leading edge and a wedge-shaped symmetric ramp portion formed along a central portion of the electrodes according to an embodiment of the present invention.
FIG. 4A is a detailed view of the wedge-shaped ramp portion of the collecting electrodes depicted in FIG. 4.

Another embodiment of the invention is depicted in FIGS. 4 and 4A wherein, in addition to bulges 407 (in this case, semi-cylindrical solid in shape) formed along the leading edge of collecting electrode 403, additional "dust traps" 414 are formed downwind of the leading edge of collecting electrode 403 creating additional quite zones. The additional quiet zones 409 formed by dust traps 414 further improve a particulate removal efficiency of the collecting electrodes and that of the overall device. As depicted, dust traps 414 may be symmetrical wedge portions having ramp portions 415 positioned on opposite surfaces of collecting electrodes 403 in an area otherwise constituting a planar portion of the electrode. Opposing ramp portions 415 rise outwardly from a planar portion of the electrode, ramp portions 415 terminating at walls 416. The slope of ramp portions 415 may be on the order of 1:1 (i.e., 45°), more preferably having a rise of no greater than 1:2 (i.e., 25°–30°) and, even more preferably greater than 1:3 (i.e., <15° to 20°). Ramp portions 415 may extend to an elevation of at least one electrode thickness in height above planar portion 406, more preferably to a height at least two electrode thicknesses, although even greater heights may be appropriate (e.g., rising to a height at least three times that of a collecting electrode thickness). Thus, if planar portion 406 is 1 mm thick, then dust traps 414 may rise 1, 2, 3 or more millimeters.

Quite zone 409 is formed in a region downwind or behind walls 416 by the redirection of airflow caused by dust trap 414 as air is relatively gently redirected along ramp portions 415. At the relatively abrupt transition of walls 416, a region of turbulent airflow is created. To affect turbulent airflow, walls 416 may be formed with a concave geometry within region 413.

While dust traps 414 are shown as a symmetrical wedge with opposing ramps located on either side of collecting electrodes 403, an asymmetrical construction may be implemented with a ramped portion located on only one surface. In addition, while only one dust trap is shown for ease of illustration, multiple dust traps may be incorporated including dust traps on alternating surfaces of each collecting electrode. Further, although the dust traps as shown shaped as wedges, other configuration may be used including, for example, semi-cylindrical geometries similar to that shown for leading edge bulges 407.

Figures 4B, 4C, 4D:
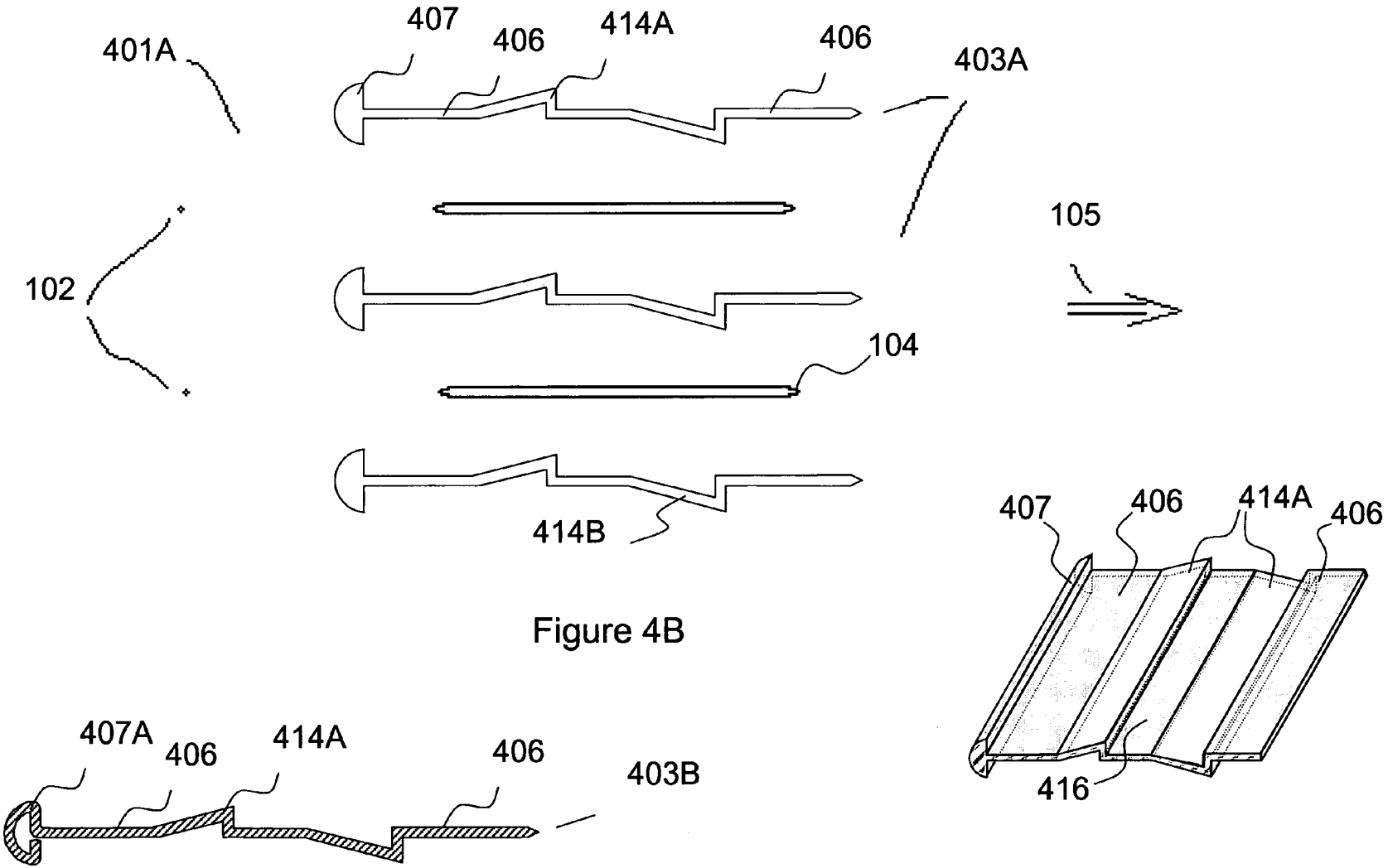
FIG. 4B is a schematic drawing in cross-section of an array of electrodes in which the collecting electrodes have an initial semi-cylindrical bulge, a trailing, plate-like portion of the electrode having a constant thickness formed into a number of ramped and planar portions.
FIG. 4C is a detailed perspective drawing of the collecting electrode of FIG. 4B.
FIG. 4D is a schematic drawing in cross-section of an alternate "skeletonized" collecting electrode applicable to the configuration of FIG. 4B.

Dust traps may also be created by forming a uniform-thickness plate into a desired shape instead using a planar substrate having various structures formed thereon resulting in variations of a thickness of an electrode. For example, as shown in FIGS. 4B and 4C, collecting electrodes 403A may comprise an initial semi-cylindrical bulge 407 formed as a semi-cylindrical solid on the leading edge of a plate, the plate being bent or otherwise formed to include planar portions 406 and dust traps 414A. Note that dust traps 414A comprise a metal plate that is the same thickness as the other, adjacent portions of the electrode, i.e., planar portions 406. The dust traps may be formed by any number of processes such as by stamping, etc.

A fully skeletonized version of a collecting electrode 403B is depicted in FIG. 4D wherein bulge 407A is formed as a half-round tube having it curved outer surface facing upwind, while the flat wall-like section is oriented facing in a downwind direction.

Figure 5:
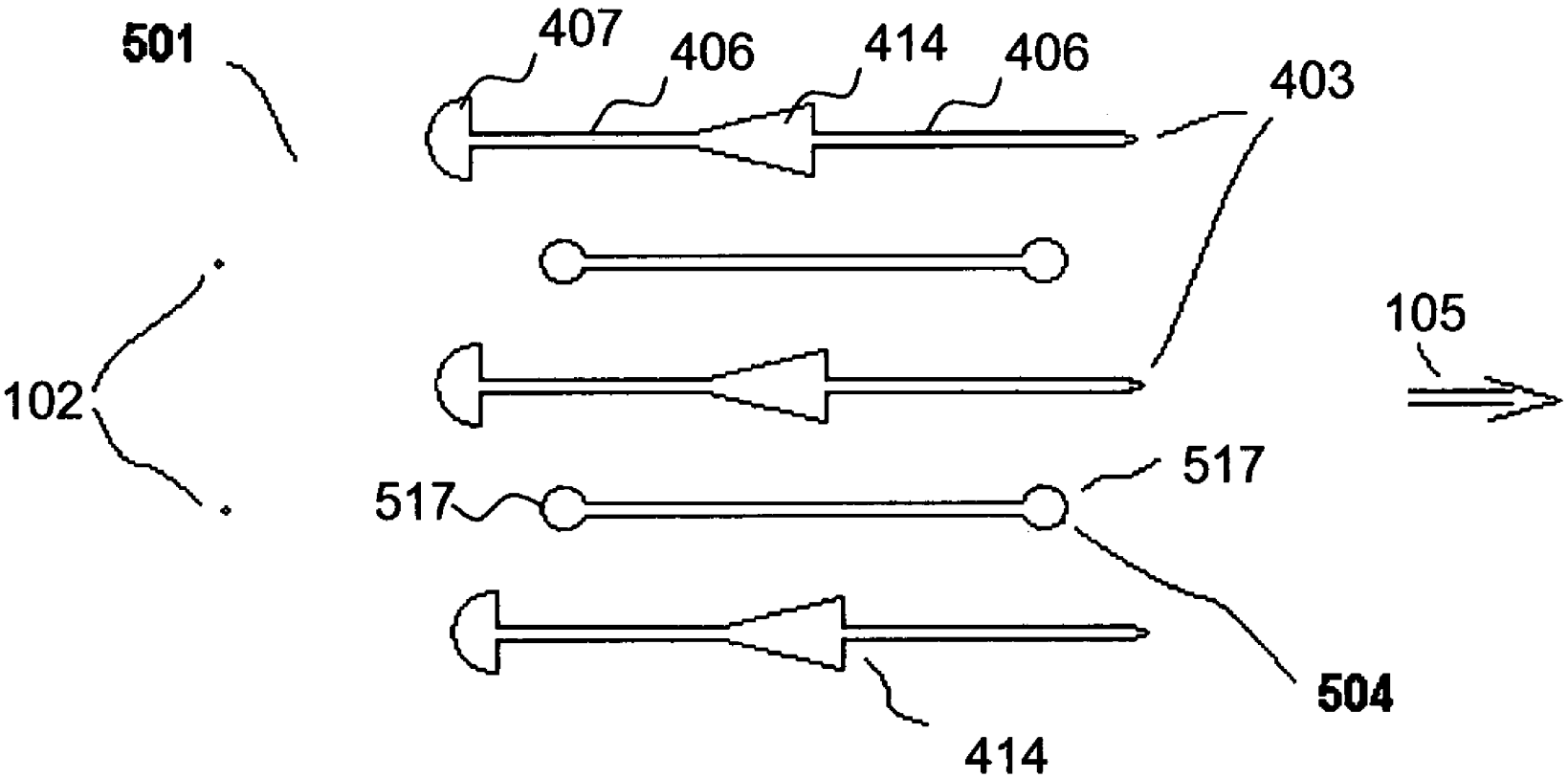
FIG. 5 is a schematic drawing of an array of electrodes including the collecting electrodes of FIG. 4 with intervening repelling electrodes having cylindrical bulges formed on both the leading and trailing edges thereof according to another embodiment of the present invention.
Figure 5A:
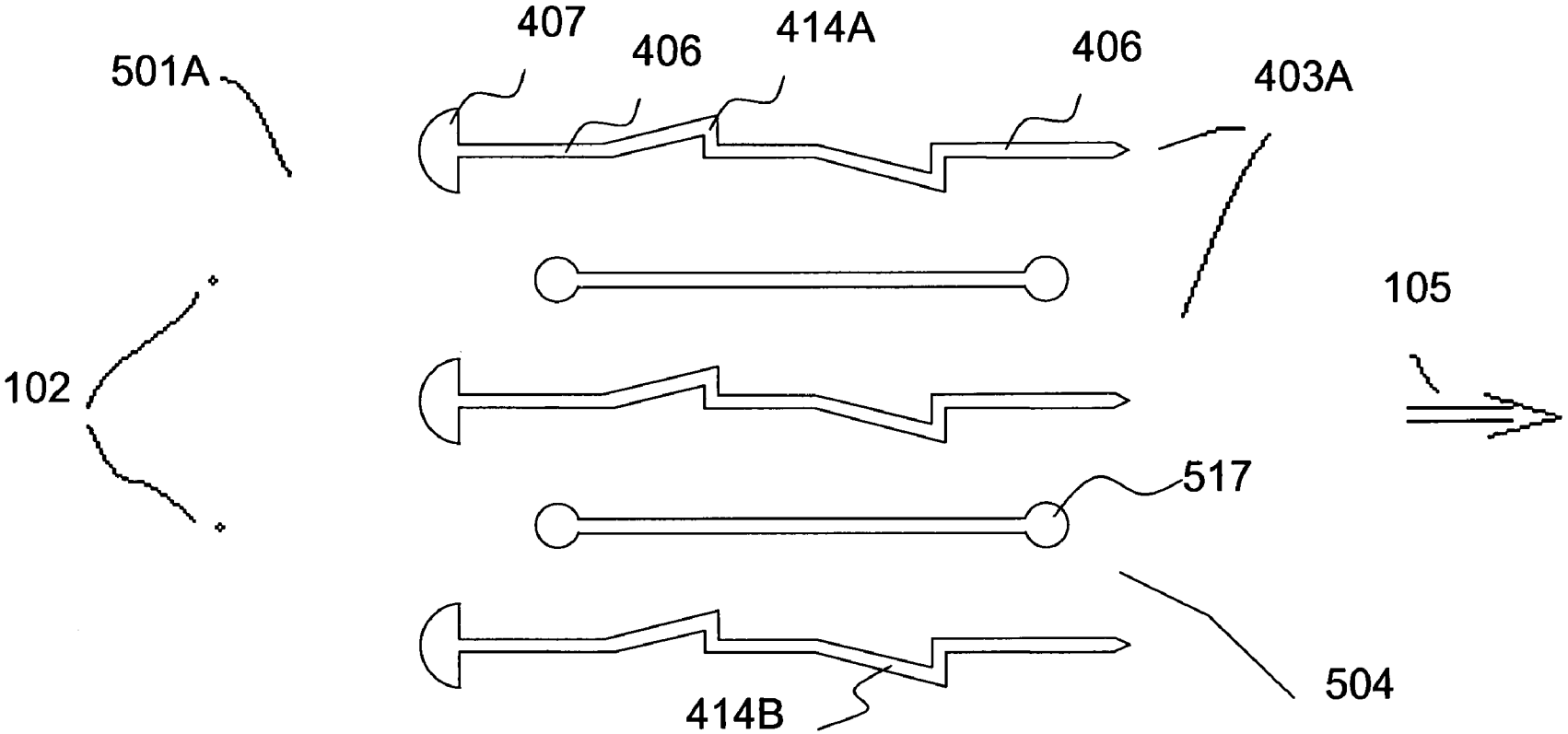
FIG. 5A is a schematic drawing of an array of electrodes including the collecting electrodes of FIG. 4C with intervening repelling electrodes having cylindrical bulges as in FIG. 5 according to another embodiment of the present invention.

Further improvements may be achieved by developing the surfaces of repelling electrodes 504 to cooperate with collecting electrodes 403 as depicted in FIGS. 5 and 5A. Referring to FIG. 5, bulges 517 (two are shown, one each on the leading and trailing edges of repelling electrodes 504) create additional air turbulence around the repelling electrodes. Although two bulges 517 are depicted, other numbers and placement may be used. In the present example, bulges 517 are located on either side (i.e., "upwind" and "downwind") of dust traps 414 of adjacent collecting electrodes 403. Internal to electrode array 501, repelling electrodes 504 are parallel to and flank either side of collecting electrodes 403.

Bulges 507 serve two purposes. The bulges both create additional air turbulence and increase the electric field strength in the areas between bulges 414 of collecting electrodes 403. That increased electric field "pushes" charged particles toward the collecting electrodes 403 and increases the probability that particulates present in the air (e.g., dust) will settle and remain on the surfaces of collecting electrodes 403.

FIG. 5A depicts a variation of the structure of FIG. 5 wherein a partially skeletonized form of collecting electrode 403A as depicted in and discussed with reference to FIGS. 4B and 4C is substituted for the collecting electrode structure of FIG. 4A.

Figure 5B:
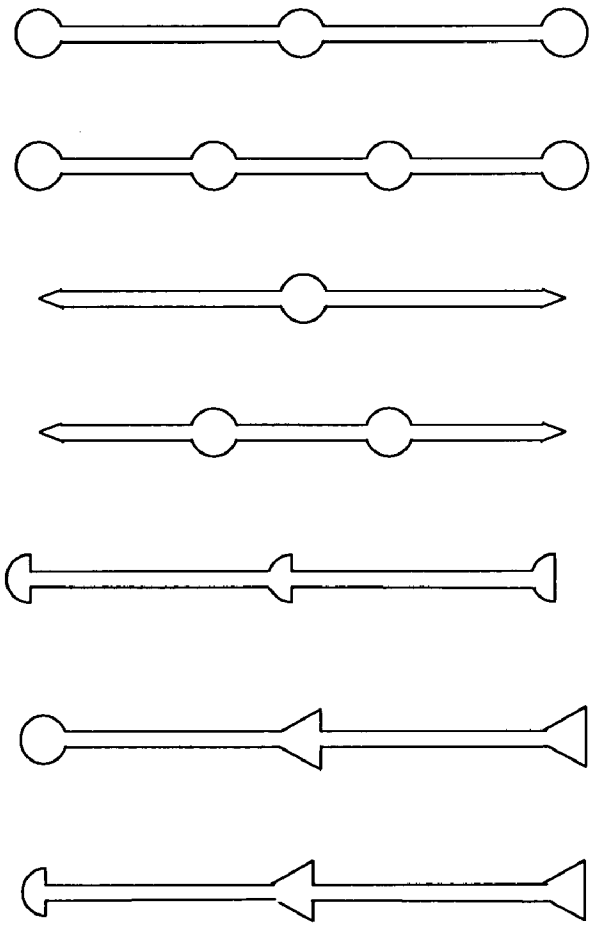
FIG. 5B is a cross-sectional diagram of alternate repelling electrode structures.

Some examples of other possible repelling electrodes structures are depicted in FIG. 5B including embodiments with protuberances located on the leading and/or trailing edges of the electrodes and/or at one or more mid-section locations. Also shown are examples of possible cross-section shapes including cylindrical and ramped structures.

Figure 6:
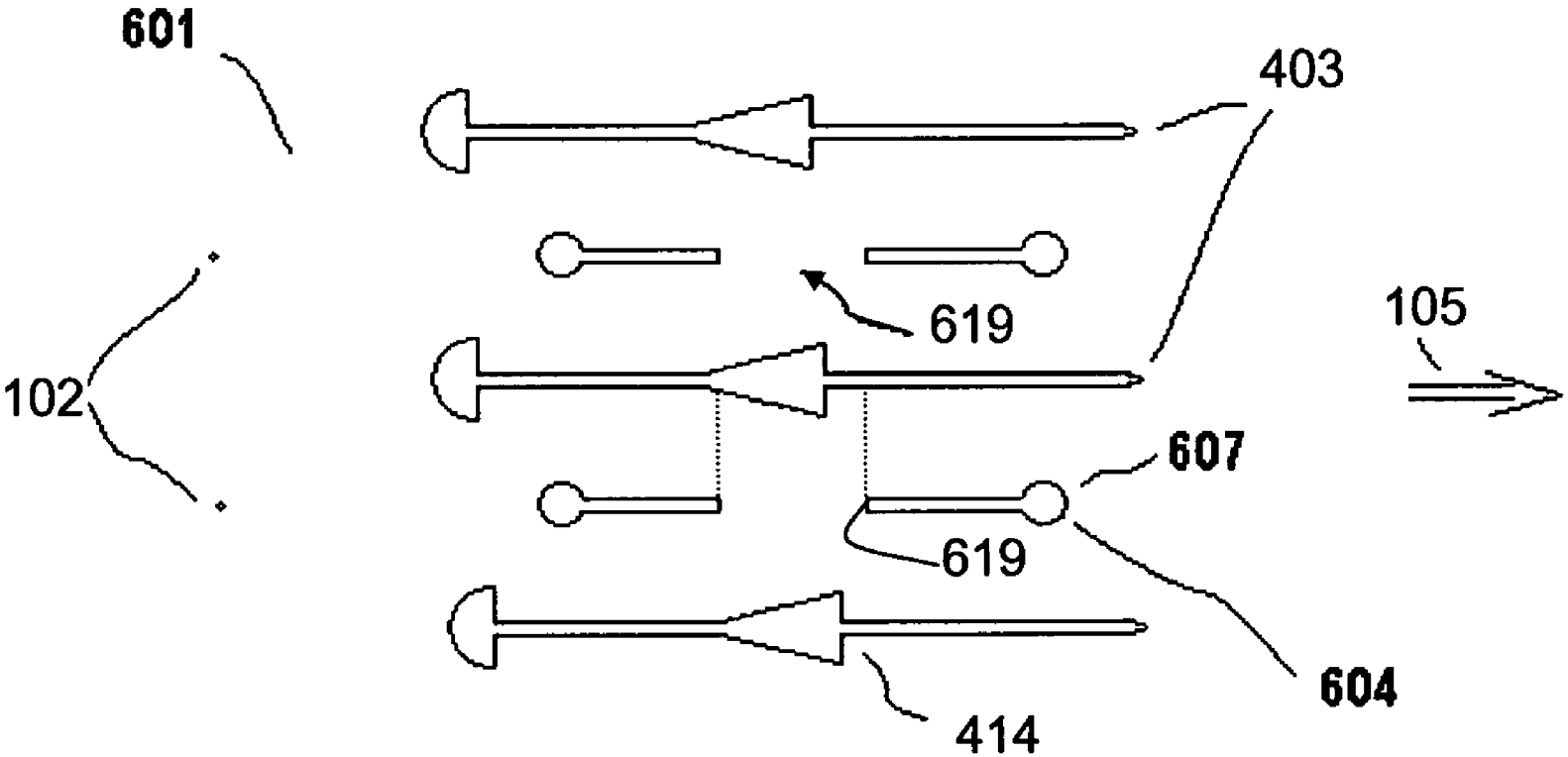
FIG. 6 is a schematic drawing of an electrode array structure similar to that of FIG. 5 wherein a void is formed in a midsection of each of the repelling electrodes.

Another configuration of repelling electrode is shown in FIG. 6. Therein, repelling electrodes 604 have voids or apertures 619 (i.e., "breaks") through the body of the electrode, the voids preferably aligned and coincident with bulges 414 of collecting electrodes 403. Thus, apertures 619 are aligned with bulges 414 such that an opening in the repelling electrode starts at or slightly after (i.e., downwind of) an initial upwind portion of an adjacent bulge (in, for example, a collecting electrode), the aperture terminating at a position at or slightly after a terminal downwind portion or edge of the bulge. Note that, although apertures 619 are depicted with a particular geometry for purposes of illustration, the aperture may be made with various modification including a wide range of holes and slots.

Apertures 619 further encourage turbulent airflow and otherwise enhance particulate removal. At the same time, this configuration avoids generation of an excessive electric field increase that might otherwise be caused by the proximity of the sharp edges of the bulges 414 to the repelling electrodes 604.

It should be noted that round or cylindrical shaped bulges 517 and 607 are located at the far upstream (leading edge) and downstream (trailing edge) ends of the repelling electrodes 504 and 604 respectively. This configuration reduces the probability of occurrence of an electrical breakdown between the edges of the repelling electrodes and the collecting electrodes, particularly in comparison with locating such bulges near a middle of the electrodes. Experimental data has shown that the potential difference between the repelling and collecting electrodes is a significant factor in maximizing device dust collection efficiency. The present configuration supports this requirement for maintaining a maximum potential difference between these groups of electrodes without fostering an electrical breakdown of the intervening fluid, e.g., arcing and/or sparking through the air.

It should also be noted that, in the embodiment of FIG. 6, the downstream or trailing edges of repelling electrodes 604 are inside that of collecting electrodes 403, i.e., the outlet edges are located closer to the inlet than the outlet edges of the collecting electrodes. This relationship further enhances a dust collecting ability while decreasing or minimizing a flow of ions out through the outlet or exhaust of the array and the device.

Figure 7:
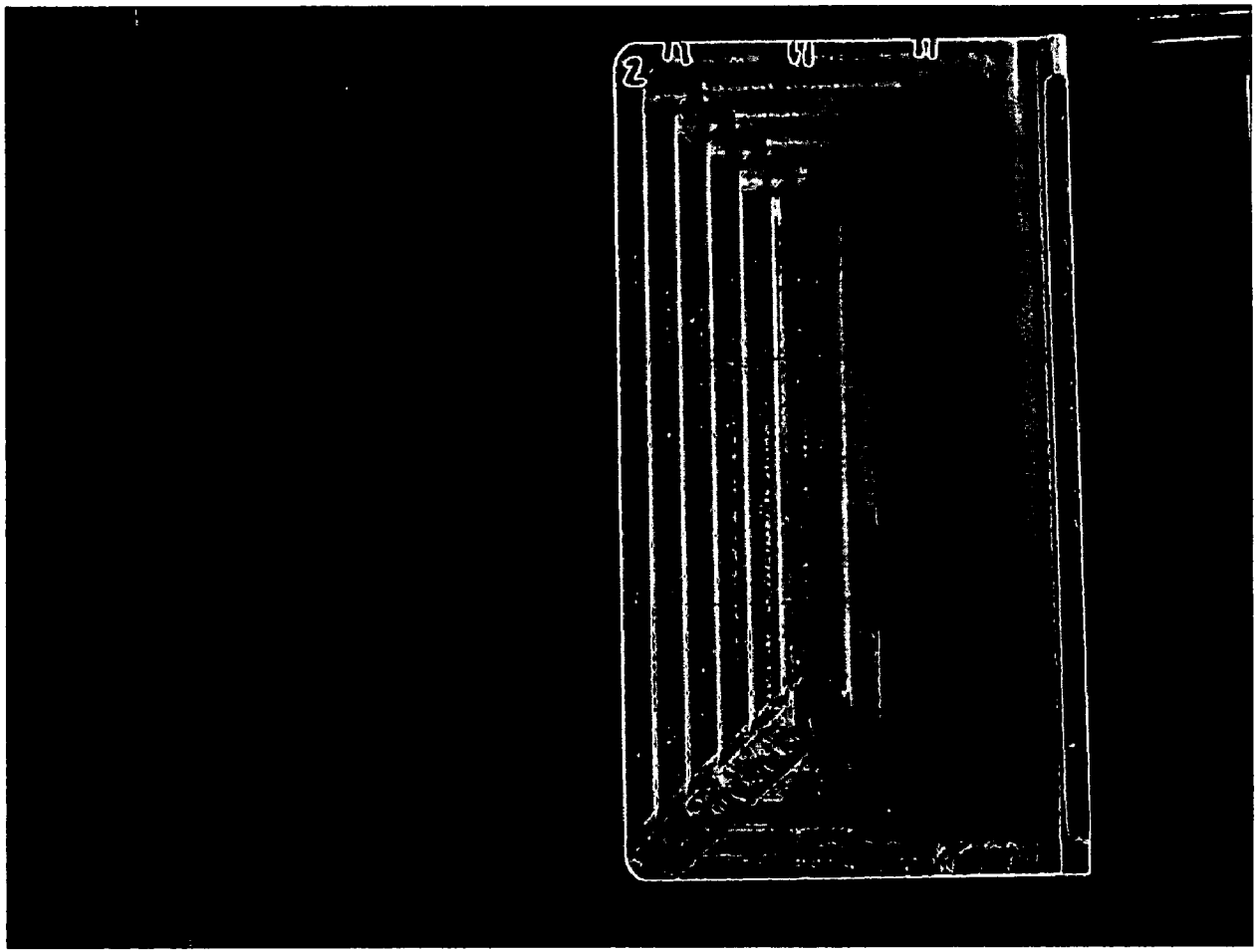
FIG. 7 is a photograph of a stepped electrode structure present along a leading edge of a collecting electrode as diagrammatically depicted in FIG. 2.

FIG. 7 is a photograph of a collecting electrode structure corresponding to FIG. 2 wherein multiple layers of conductive material are layered to produce a rounded leading edge structure.

Although certain embodiments of the present invention have been described with reference to the drawings, other embodiments and variations thereof fall within the scope of the invention. In addition, other modifications and improvements may be made and other features may be combined within the present disclosure. For example, the structures and methods detailed in U.S. patent application Ser. No. 10/724,707 filed Dec. 2, 2003 and entitled Corona Discharge Electrode And Method Of Operating The Same describes a construction of corona electrodes and method of and apparatus for rejuvenating the corona electrodes that may be combined within the spirit and scope of the present invention to provide further enhancements and features.

It should be noted and understood that all publications, patents and patent applications mentioned in this specification are indicative of the level of skill in the art to which the invention pertains. All publications, patents and patent applications are herein incorporated by reference to the same extent as if each individual publication, patent or patent application was specifically and individually indicated to be incorporated by reference in its entirety.

The invention claimed is:

1. An electrostatic air cleaning device comprising:

a plurality of corona electrodes having respective ionizing edges;

at least one complementary electrode having a substantially planar portion and a protuberant portion extending outwardly in a lateral direction substantially perpendicular to a desired fluid-flow-direction; and at least one repelling electrode having a substantially planar portion and at least one protuberant portion extending outwardly in a lateral direction substantially perpendicular to said desired fluid-flow direction.

2. The electrostatic air cleaning device according to claim 1 wherein said planar and protuberant portions of said complementary and repelling electrodes are substantially coextensive with a width of respective ones of said complementary and repelling electrodes.

3. The electrostatic air cleaning device according to claim 1 wherein said protuberant portions of said complementary and repelling electrodes each comprise a portion having a greater thickness than a thickness of a respective planar portion of said complementary and repelling electrodes.

4. The electrostatic air cleaning device according to claim 1 wherein each of said protuberant portions of said complementary and repelling electrodes comprises a portion having a thickness substantially equal to a thickness of said planar portion of said complementary and repelling electrodes.

5. The electrostatic air cleaning device according to claim 1 wherein each of said protuberant portions of said complementary and repelling electrodes extends in a lateral direction a distance greater than a thickness of a respective one of said planar portions of said complementary and repelling electrodes.

6. The electrostatic air cleaning device according to claim 1 wherein each of said protuberant portions of said complementary and repelling electrodes includes a frontal section promoting a substantially laminar fluid-flow in said fluid-flow direction and a rear section promoting a substantially turbulent fluid-flow.

7. The electrostatic air cleaning device according to claim 1 wherein said protuberant portion of said complementary electrodes is arranged to promote precipitation of a particulate from a fluid onto said complementary electrodes.

8. The electrostatic air cleaning device according to claim 1 wherein said protuberant portions of said complementary and repelling electrodes each create an area of reduced fluid speed.

9. The electrostatic air cleaning device according to claim 1 wherein each of said protuberant portions of said complementary and repelling electrodes has a characteristic Reynolds number at least two orders of magnitude more than a maximum Reynolds number of said planar portion.

10. The electrostatic air cleaning device according to claim 9 wherein said Reynolds numbers of said protuberant portions of said complementary and repelling electrodes are greater than 1000 and said maximum Reynolds number of said planar portion is greater than 1000 is less than 100.

11. The electrostatic air cleaning device according to claim 1 wherein said protuberant portions of said complementary and repelling electrodes are each formed as a cylindrical solid.

12. The electrostatic air cleaning device according to claim 1 wherein said protuberant portion of said complementary electrode is formed as a half-cylindrical solid having a curved surface facing outward from said collecting electrode and a substantially flat, walled surface attached to said planar portion of said complementary electrode.

13. The electrostatic air cleaning device according to claim 1 wherein said portions of said complementary and repelling electrodes are each formed as a cylindrical tube.

14. The electrostatic air cleaning device according to claim 1 wherein said protuberant portion of said complementary electrode is formed as a half-round tube having a curved surface facing outward from said complementary electrode.

15. The electrostatic air cleaning device according to claim 1 further comprising a plurality of said complementary electrodes positioned substantially parallel to one another and spaced apart from one another along said lateral direction, said complementary electrodes spaced apart from said corona electrodes in a longitudinal direction substantially parallel to a desired fluid-flow direction.

16. The electrostatic air cleaning device according to claim 1 wherein said protuberant portions of said complementary and repelling electrodes extend outward from respective planes including said planar portion portions of said complementary and repelling electrodes for a distance that is at least equal to a thickness of respective ones of said planar portions.

17. The electrostatic air cleaning device according to claim 16 wherein said planar portions of said complementary and repelling electrodes each have a substantially uniform thickness and extend along a longitudinal direction substantially parallel to a desired fluid-flow direction a length at least five times that of a longitudinal extent of corresponding ones of said protuberant portions.

18. The electrostatic air cleaning device according to claim 1, said complementary electrode further comprising a trap portion spaced apart from said protuberant portion of said complementary electrode by at least a portion of said planar portion of said complementary electrode, said trap portion extending outwardly in said lateral direction.

19. The electrostatic air cleaning according to claim 18 wherein said trap portion of said complementary electrode is substantially coextensive with said width of said complementary electrode.

20. The electrostatic air cleaning device according to claim 18 wherein said trap portion of said complementary electrode comprises a ramp increasing in height along said complementary electrode in a direction parallel to a desired airflow direction.

21. The electrostatic air cleaning device according to claim 18 wherein said trap portion of said complementary electrode comprises a wedge extending outward from opposing planar surfaces of said planar portion.

22. The electrostatic air cleaning device according to claim 1 further comprising adjacent pairs of said complementary electrodes wherein said repelling electrode is positioned between said adjacent pairs of said complementary electrodes.

23. The electrostatic air cleaning device according to claim 22 wherein said repelling electrode includes said protuberant portion formed along leading and trailing edges of said repelling electrode.

24. The electrostatic air cleaning device according to claim 22 wherein said repelling electrode includes said protuberant portion located in a midsection thereof.

25. The electrostatic air cleaning device according to claim 22 wherein said repelling electrode includes an aperture formed in a midsection thereof.

26. The electrostatic air cleaning device according to claim 1 further comprising a high voltage power supply connected to said corona electrodes and to said complementary electrode and operational to generate a corona discharge.

27. An electrostatic air cleaning device comprising:

a plurality of corona electrodes having respective ionizing edges; and at least one collecting electrode having a substantially planar portion and a raised trap portion formed on a midsection of said collecting electrode and extending outwardly above a height of said substantially planar portion for a distance greater than a nominal thickness of said planar portion; and a repelling electrode positioned intermediate adjacent pairs of said collecting electrodes; and a repelling electrode positioned intermediate adjacent pairs of said collecting electrodes.

28. The electrostatic air cleaning device according to claim 27 further comprising a raised leading portion formed on a leading edge of said collecting electrode.

29. The electrostatic air cleaning device according to claim 28 wherein said raised leading portion comprises a curved surface and said raised trap portion comprises a ramped surface.

30. The electrostatic air cleaning device according to claim 27 wherein said repelling electrode comprises a raised portion formed on opposite edges thereof.

31. The electrostatic air cleaning device according to claim 27 wherein said repelling electrode comprises a raised portion formed in the midsection thereof.

32. The electrostatic air cleaning device according to claim 27 wherein said repelling electrode includes an aperture formed in a midsection thereof.

33. An electrostatic air cleaning device comprising:

a plural first number of corona electrodes having respective ionizing edges;

a plural second number of collecting electrodes spaced apart from (i) each other in a lateral direction and (ii) said corona electrodes in a longitudinal direction;

a plural third number of repelling electrodes that are spaced apart and substantially parallel to the collecting electrodes; and an electrical power source connected to supply said corona, collecting and repelling electrodes with an operating voltage to produce a high intensity electric field in an inter-electrode space between said corona, collecting and repelling electrodes, said collecting and repelling electrodes each having a profile including bulges causing a turbulent fluid flow through an inter-electrode passage between adjacent ones of said collecting and repelling electrodes.

34. An electrostatic air cleaning device according to claim 33, wherein a leading edge of each of said collecting electrodes has a rounded bulge.

35. The electrostatic air cleaning device according to claim 33 wherein said rounded bulge has an overall height or at least 4 mm and a planar portion of said repelling electrodes adjacent said edge has a nominal uniform thickness of no more than 2 mm.

36. An electrostatic air cleaning device according to claim 33, wherein a leading edge of each of said collecting electrodes has a half-rounded bulge.

37. An electrostatic air cleaning device according to claim 33, wherein an edge of an electrode that is positioned closest to an air passage outlet has a greatest electrical potential difference with respect to the corona electrode.

38. An electrostatic air cleaning device according to claim 33, wherein an edge of an electrode closest to said air passage outlet has an electrical potential maintained substantially at a ground potential.

39. An electrostatic air cleaning device according to claim 33, wherein said bulges have a profile promoting a laminar airflow adjacent a leading edge thereof.

40. The electrostatic air cleaning device according to claim 1 wherein said plurality of corona electrodes are longitudinally spaced from said complementary electrode whereby said complementary electrode does not extend between said corona electrodes.

41. The electrostatic air cleaning device according to claim 27 wherein said plurality of corona electrodes are longitudinally spaced from said collecting electrode whereby said collecting electrode does not extend between said corona electrodes.

42. The electrostatic air cleaning device according to claim 27 further comprising a least one repelling electrode having a substantially planar portion and a raised trap portion formed on a midsection of said repelling electrode and extending outwardly above a height of said substantially planar portion for a distance greater than a nominal thickness of said planar portion of said repelling electrode.

43. The electrostatic air cleaning device according to claim 33 wherein said plurality of corona electrodes are longitudinally spaced from said collecting electrode whereby said collecting electrode does not extend between said corona electrodes.

44. An electrostatic air cleaning device comprising:

a plurality of corona electrodes having respective ionizing edges;

at least one complementary electrode configured to impart motion to a fluid in a desired fluid-flow direction, said complementary electrode having a substantially planar portion and a protuberant portion extending outwardly in a lateral direction substantially perpendicular to said desired fluid-flow direction; and at least one repelling electrode having a substantially planar portion and at least one protuberant portion extending outwardly in a lateral direction substantially perpendicular to said desired fluid flow direction.

* * * * *